US007479074B1

(12) United States Patent
Pierce

(10) Patent No.: US 7,479,074 B1
(45) Date of Patent: Jan. 20, 2009

(54) BATTING TEE

(75) Inventor: Ronald I. Pierce, Troy, AL (US)

(73) Assignee: Ron Pierce, Troy, AL (US)

( * ) Notice: Subject to any disclaimer, the term of this patent is extended or adjusted under 35 U.S.C. 154(b) by 9 days.

(21) Appl. No.: 11/438,112

(22) Filed: May 22, 2006

Related U.S. Application Data

(60) Provisional application No. 60/723,506, filed on Oct. 4, 2005.

(51) Int. Cl.
*A63B 69/00* (2006.01)
*A63B 69/40* (2006.01)

(52) U.S. Cl. ..... 473/417; 473/422

(58) Field of Classification Search ..... 473/417, 473/422, 431, 451
See application file for complete search history.

(56) References Cited

U.S. PATENT DOCUMENTS 3,139,282 A * 6/1964 Lande ..... 473/417
4,664,374 A * 5/1987 Groves ..... 473/417
4,709,924 A 12/1987 Wilson et al.
4,819,937 A * 4/1989 Gordon ..... 473/417
5,004,234 A 4/1991 Hollis
5,106,085 A * 4/1992 Lewy ..... 473/417
5,388,823 A 2/1995 Prieto
5,928,092 A 7/1999 Keeter et al.
6,979,273 B2 12/2005 Tsai

* cited by examiner

*Primary Examiner*—Mitra Aryanpour
(74) *Attorney, Agent, or Firm*—Crose Law LLC; Bradley D. Crose

(57) ABSTRACT

Apparatus and method for a batting tee which provides an effective and useful device for improving a user's baseball swing. The present invention comprises a portable regulation size home plate which has a swinging arm member rotatably attached thereto which member has a first and second upright-standing batting tee thereon which are each adjustable in height. The rotatable member is attached to the home plate by means of a fastener which allows the member to swing 360 degrees around the home plate in the horizontal plane. The particular placement of the batting tees about the home plate allows the device to be used to teach a user batter how to hit balls thrown in each position about the home plate.

12 Claims, 2 Drawing Sheets

BATTING TEE

REFERENCE TO PRIOR APPLICATIONS

This application claims priority to U.S. Provisional Patent Application No. 60/723,506 filed on Oct. 24, 2005 by Ronald I. Pierce, the above-named applicant, entitled "Multi-Tee."

BACKGROUND OF THE INVENTION

1. Field of the Invention

The present invention generally relates to batting tees and, more particularly, is concerned with a batting tee having multiple tees and positions.

2. Description of the Prior Art

Batting tees have been described in the prior art. However, none of the prior art discloses the unique features of the present invention.

U.S. Pat. No. 5,004,234, dated Apr. 2, 1991 to Hollis, disclosed an adjustable batting tee.

U.S. Pat. No. 4,819,937 dated Apr. 11, 1989 to Gordon disclosed a combined batting tee and strike indicator.

U.S. Pat. No. 5,388,823 dated Feb. 14, 1995 to Prieto disclosed an adjustable baseball batting tee.

U.S. Pat. No. 4,709,924 dated Dec. 1, 1987 to Wilson, et al., disclosed an adjustable batting tee.

U.S. Pat. No. 6,979,273 dated Dec. 27, 2005 to Tsai disclosed a rotary baseball batting practice device.

U.S. Pat. No. 5,928,092 dated Jul. 27, 1999 to Keeter, et al., disclosed a batting tee for baseball and softball.

While these batting tees may be suitable for the purposes in which they were designed, they would not be suitable for the purposes of the present invention as hereinafter described.

SUMMARY OF THE PRESENT INVENTION

The present invention discloses a batting tee which provides an effective and useful device for improving a user's baseball swing. The present invention comprises a portable regulation size home plate which has a swinging arm member rotatably attached thereto which member has a first and second upright-standing batting tee thereon which are each adjustable in height. The rotatable member is attached to the home plate by means of a fastener which allows the member to swing 360 degrees around the home plate in the horizontal plane. The particular placement of the batting tees about the home plate allows the device to be used to teach a user batter how to hit balls thrown in each position about the home plate.

An object of the present invention is to provide a user player an easy-to-use device which can be used to teach the user to hit a ball thrown in the three basic pitch locations which are the inside, outside and middle of the plate. A further object of the present invention is to provide a device which is easy to use. A further object of the present invention is to provide a device which can be easily and cheaply manufactured.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
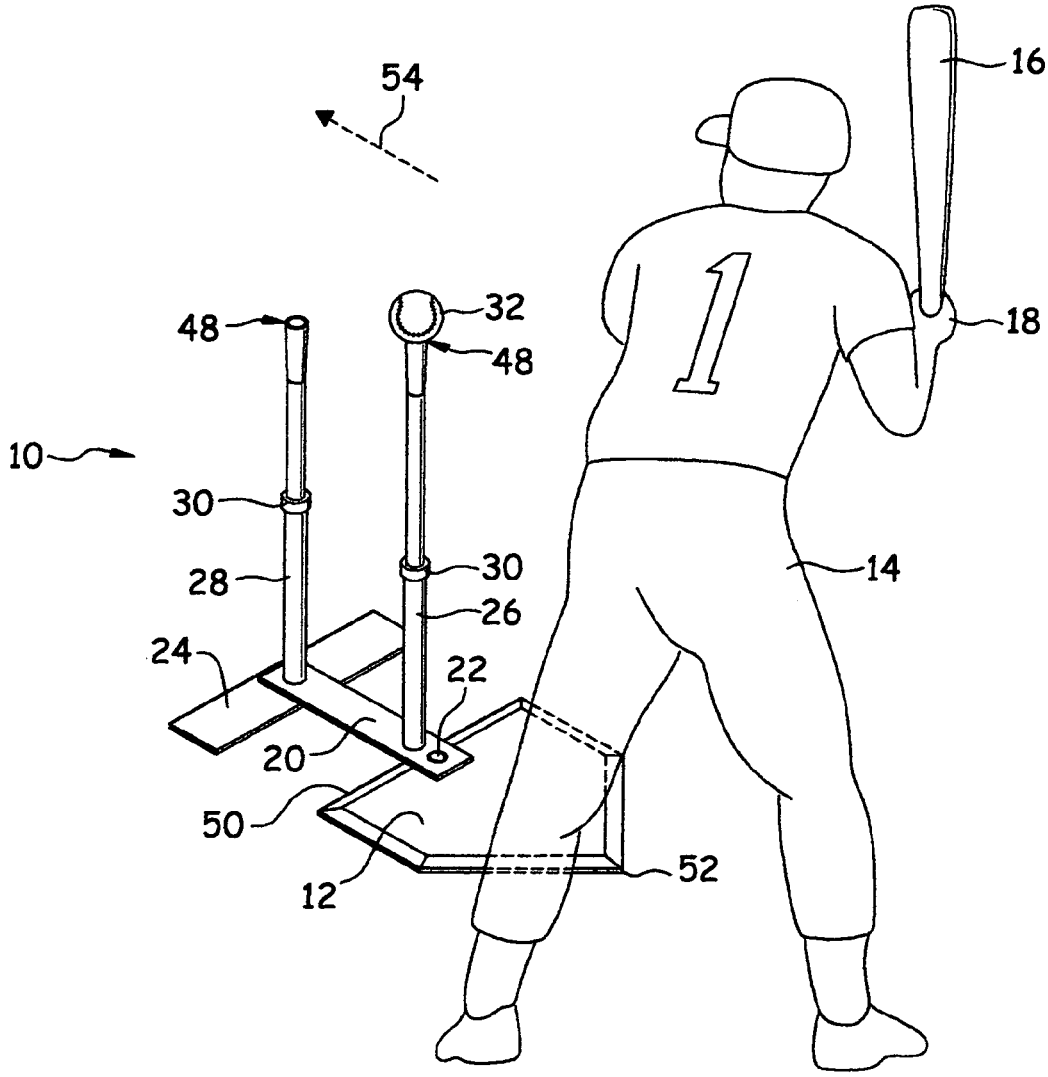
FIG. 1 is perspective view of the present invention.

With regard to reference numerals used, the following numbering is used throughout the drawings.

10 present invention
12 plate
14 user
16 bat
18 arm
20 swinging arm
22 pivot member
24 support foot
26 batting tee
28 batting tee
30 adjustment member
32 ball
34 6 o'clock position
36 4 o'clock position
38 2 o'clock position
40 10 o'clock position
42 8 o'clock position
44 inner member
46 inner member
48 ball support
50 front
52 rear

DETAILED DESCRIPTION OF THE PREFERRED EMBODIMENTS

Figure 2:
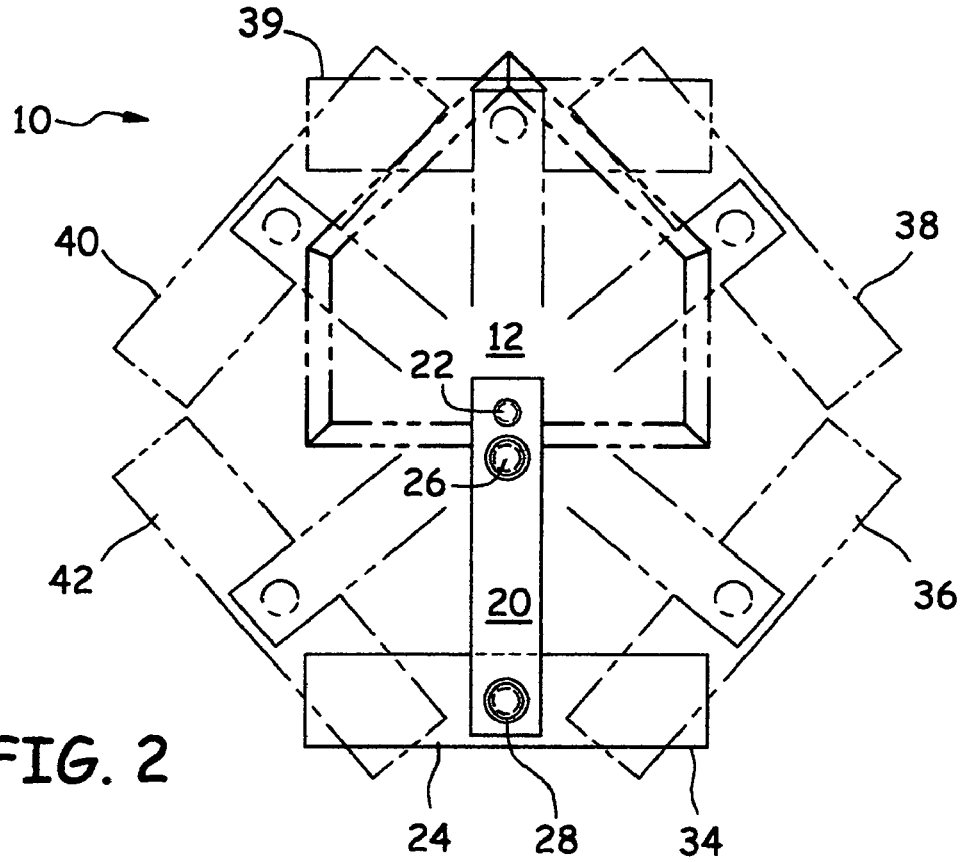
FIG. 2 is a plan view of the present invention.
Figure 3:
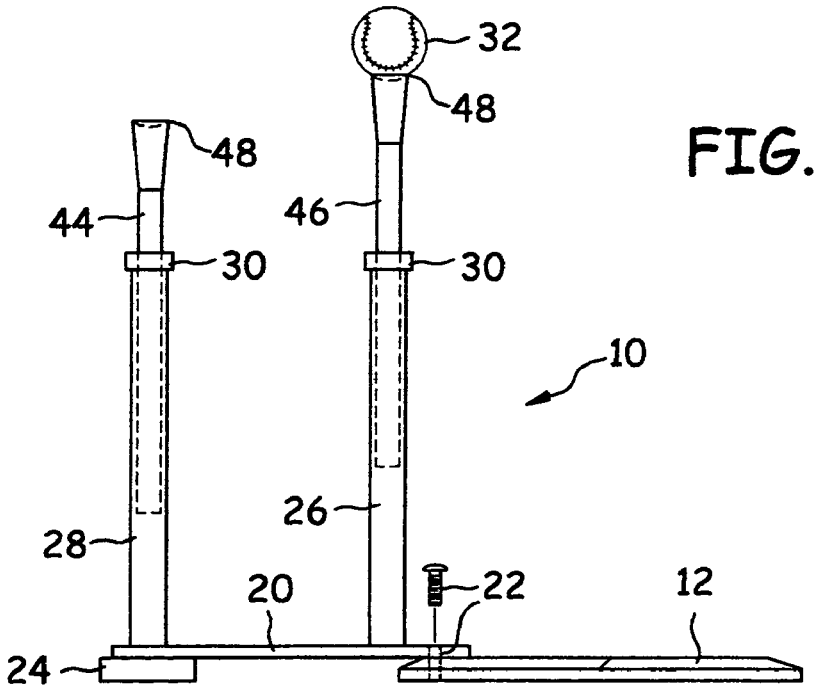
FIG. 3 is an elevation view of the present invention.

The following discussion describes in detail at least one embodiment of the present invention. This discussion should not be construed, however, as limiting the invention to those particular embodiments since practitioners skilled in the art will recognize numerous other embodiments as well. For a definition of the complete scope of the invention, the reader is directed to the appended claims. FIGS. 1-3 illustrate the present invention wherein a batting tee is disclosed.

Turning to FIG. 1, shown therein is the present invention 10 having a standard size plate 12 which rests on a supporting surface wherein a user 14 is holding a bat 16 in the hand 18 of the user's arm. The present invention 10 has a swinging arm 20 which is rotatably attached at a pivot point 22 to the plate 12 so that the swinging arm can be rotated 360 degrees around the plate in the horizontal plane. The front 50 of the plate has the swinging arm 20 attached near it. The rear 52 of the plate is also shown. Attached to the distal end of the swinging arm 20 is a support foot 24 which rests on the supporting surface. A first batting tee 26 and a second batting tee 28, each tee 26, 28 having upper and lower ends, are attached to the upper surface of swinging arm 20. Batting tees 26 and 28 are each hollow being adjustable in height using adjustment members 30 so that a baseball 32 can be placed on the upper end of the batting tee which forms a ball support 48 on the upper end of each batting tee 26 or 28. The pivot member 22 may be a fastener or like member such as a bolt. Because of the design of this tee, a right or left handed batter 14 can use this device with ease. Direction arrow 54 indicates the swing direction. Putting a ball on tee 26, with tee 28 in a lower position, will allow the hitter 14 to practice hitting balls 32 that are thrown down the middle of the plate 12.

Turning to FIG. 2, shown therein is the present invention 10 with the home plate 12 having a swinging arm 20 rotatably attached at pivot member 22 along with the support foot 24 and the first 26 and second 28 batting tees thereon showing the support foot 24 being moved around the plate 12 360 degrees in the horizontal plane. The support foot 24 can be moved around the home plate 12 so that it is disposed at position 34, 36 38, 39, 40 and 42 which correspond to the 6 o'clock, 4 o'clock, 2 o'clock, 12 o'clock, 10 o'clock and 8 o'clock positions, respectively. By placing a ball on tee 28, with arm 20 at the 4:00 o'clock position, a right handed hitter will be able to practice hitting inside pitches in the correct hitting zone. By placing a ball on tee 28, with arm 20 at the 10:00 o'clock position, a right handed hitter will be able to practice hitting outside pitches in the correct hitting zone. By placing a ball on tee 26, with arm 20 at the 6:00 o'clock position, a right handed hitter will be able to practice hitting middle pitches in the correct hitting zone. By placing a ball on tee 28, with arm 20 at the 8:00 o'clock position a left handed hitter will be able to practice hitting inside pitches in the correct hitting zone. By placing a ball on tee 28, with arm 20 at the 2:00 o'clock position, a left handed hitter will be able to practice hitting outside pitches in the correct hitting zone. By placing a ball on tee 26, with arm 20 at the 6:00 o'clock position, a left handed hitter will be able to practice hitting middle pitches in the correct hitting zone. By placing a ball on tee 26 only, with arm 20 at the 12 o'clock position, either a left or right handed hitter can practice hitting down on the ball by raising tee 28 to a higher position than the ball on tee 26. By placing a ball on both tee 26 and 28, with arm 20 at either the 8 o'clock or 4 o'clock position, a left or right handed batter will be able to practice getting their hands through the ball at contact by hitting both of the balls on a level plane so as to cause the ball on tee 26 to go straight and the ball on tee 28 to go either to the left or the right side of the infield depending on whether the hitter is left or right handed.

Turning to FIG. 3, shown therein is the present invention 10 showing home plate 12, the swinging arm 20 rotatably attached at pivot member 22 to the home plate having the support foot 24 thereon showing a first batting tee 26 and a second batting tee 28 both having adjustable members 30 thereon and having a ball 32 disposed on batting tee 28. It can be seen that the batting tee 26 and 28 each contain an outer member along with a telescoping inner member 44, 46 which are each slidably adjustable in the outer members of the batting tee 26, 28 so as to be telescopic in nature with each batting tee having a ball support 48 thereon at the upper end. It is expected that the present invention 10 will be made of molded rubber or plastic materials varying in size and thickness. Tee 26 is expected to be disposed about two inches from the edge of the plate 12 and centered and tee 28 will be about eighteen inches away on swinging arm 20.

I claim:

1. A method for providing a batting tee to allow a user to practice hitting a ball placed on the batting tee, comprising the steps of:

a. providing a home plate for being placed on a support surface, said home plate having a top surface and front and rear ends;

b. providing a swinging arm having a length substantially equal to or greater that the length of said home plate; a top surface and first and second ends and attaching the first end of the swinging arm to the top surface of the home plate so that the swinging arm can be rotated around the home plate;

c. providing a support foot on the second end of the swinging arm, such that the support foot is spaced from the front edge of said home plate a distance that is substantially equal to or greater than the length of said home plate, and such that the support foot can be positioned perpendicular to either side of said home plate, perpendicularly in front of said home plate, and any radial position in between, and having a width that is substantially equal to or greater than the width of said home plate and extending transversely thereto forming a T-shape therewith, thereby providing support and stability to the swinging arm; and wherein the home plate, the swinging arm, and the support foot act together to provide a planar surface area that is adapted to be placed on the ground and function to provide maximum stability and a very low center of gravity for the entire apparatus; and, d. providing a first and second telescopic upright standing batting tee, configured for disposition adjacent to said home plate, each batting tee having upper and lower ends, both are adjustable telescopically, and both are simultaneously attached on the swinging arm wherein the first batting tee is disposed on the first end of the swinging arm and the second batting tee is disposed on the second end of the swinging arm such that stability to the apparatus is maximized; and wherein each of the first and second batting tees are adjustable in height so that the ball can be placed on the first or second batting tee; and such that both the first and second batting tees are configured for positioning adjacent to said home plate at the same time.

2. The method of claim 1, wherein the swinging arm is rotatable 360 degrees around the home plate in the horizontal plane.

3. The method of claim 2, wherein each of the first and second batting tees has an outer member and an inner member, wherein the inner member is slidable in the outer member, wherein the inner member can be secured to the outer member at various positions so that the height of the first and second batting tees can be varied.

4. The method of claim 3, further comprising the steps of:

a. placing a ball on the second batting tee;

b. rotating the swinging arm to the 4 o'clock position; and, c. wherein a right handed hitter can learn to hit inside pitches in the correct hitting zone.

5. The method of claim 4, further comprising the steps of:

a. placing a ball on the second batting tee;

b. rotating the swinging arm to the 10 o'clock position; and, c. wherein a right handed hitter can learn to hit outside pitches in the correct hitting zone.

6. The method of claim 5, further comprising the steps of:

a. placing a ball on the first batting tee;

b. rotating the swinging arm to the 6 o'clock position; and, c. wherein a right handed hitter can learn to hit middle pitches in the correct hitting zone.

7. The method of claim 6, further comprising the steps of:

a. placing a ball on the second batting tee;

b. rotating the swinging arm to the 8 o'clock position; and, c. wherein a left handed hitter can learn to hit inside pitches in the correct hitting zone.

8. The method of claim 7, further comprising the steps of:

a. placing a ball on the second batting tee;

b. rotating the swinging arm to the 2 o'clock position; and, c. wherein a left handed hitter can learn to hit outside pitches in the correct hitting zone.

9. The method of claim 8, further comprising the steps of:

a. placing a ball on the first batting tee;

b. rotating the swinging arm to the 6 o'clock position; and, c. wherein a left handed hitter can learn to hit middle pitches in the correct hitting zone.

10. The method of claim 9, further comprising the steps of:

a. placing a ball on the first batting tee;

b. rotating the swinging arm to the 12 o'clock position;

c. raising the second batting tee to a higher level than the ball on the first batting tee; and, d. wherein a user can learn to hit down on the ball on the first batting tee.

11. The method of claim 10, further comprising the steps of:

a. placing a ball on each of the first and second batting tee;

b. rotating the swinging arm to the 4 o'clock position;

c. adjusting the first and the second batting tee to the same level; and, d. wherein a right handed user can practice getting their hands through the ball at contact by causing the ball on the first tee to go straight and the ball on the second tee to go to the left side of the infield.

12. The method of claim 11, further comprising the steps of:

a. placing a ball on each of the first and second batting tee;

b. rotating the swinging arm to the 8 o'clock position;

c. adjusting the first and the second batting tee to the same level; and, d. wherein a right handed user can practice getting their hands through the ball at contact by causing the ball on the first tee to go straight and the ball on the second tee to go to the right side of the infield.

* * * * *